United States Patent [19]

Friedli

[11] 4,196,067

[45] Apr. 1, 1980

[54] ABSORPTION OF MAGNETIC FIELD LINES IN ELECTROLYTIC REDUCTION CELLS

[75] Inventor: Hans Friedli, Steg, Switzerland

[73] Assignee: Swiss Aluminium Ltd., Chippis, Switzerland

[21] Appl. No.: 7,428

[22] Filed: Jan. 29, 1979

[30] Foreign Application Priority Data

Feb. 7, 1978 [CH] Switzerland ..... 1355/78

[51] Int. Cl.[2] ..... C22D 3/02

[52] U.S. Cl. ..... 204/243 M; 204/228; 204/244

[58] Field of Search ..... 204/243 M, 243 R, 228, 204/244–247, 67

[56] References Cited

U.S. PATENT DOCUMENTS

| | | | |
|---|---|---|---|
| 2,874,110 | 2/1959 | Thayer | 204/243 M |
| 2,880,157 | 3/1959 | Wleügel | 204/243 M |
| 3,719,577 | 3/1973 | Robl et al. | 204/243 M |
| 3,935,090 | 1/1976 | Petrusenko et al. | 204/243 R |
| 3,948,749 | 4/1976 | Sargent | 204/243 R X |
| 4,033,846 | 7/1977 | Engesland | 204/243 R X |
| 4,049,528 | 9/1977 | Morel et al. | 204/243 M |

*Primary Examiner*—Arthur C. Prescott
*Attorney, Agent, or Firm*—Bachman and LaPointe

[57] ABSTRACT

The vertical magnetic force lines in electrolytic reduction cells, in particular in cells for the production of aluminum, are absorbed by a device comprising the steel pot shell and a covering which covers the upper part of the cell and is magnetically connected to the steel shell. The effect of this covering is uniform over the whole of the cell. The covering is made of a magnetic material which conducts well, and it can for example be in the form of a hood, frame or cross bars.

15 Claims, 5 Drawing Figures

ABSORPTION OF MAGNETIC FIELD LINES IN ELECTROLYTIC REDUCTION CELLS

BACKGROUND OF THE INVENTION

The invention concerns a device for the absorption of vertical magnetic field lines in electrolytic cells, in particular in cells for the production of aluminum.

To win aluminum electrolytically from aluminum oxide, the latter is dissolved in a fluoride melt made up mainly of cryolite ($Na_3AlF_3$). The aluminum deposited at the cathode gathers under the fluoride melt on the carbon floor of the cell where the liquid aluminum forms the cathode. The level of liquid aluminum in the cell rises by about 1.5–2 cm per day and is removed from the cell, generally once a day, using a suction device.

In the conventional process anodes made of amorphous carbon dip into the melt from above and supply direct current to the fluoride melt. As a result of the electrolytic decomposition of the aluminum oxide, oxygen is formed at the anodes and combines with the carbon of the anodes to form CO and $CO_2$. When a carbon anode has been consumed, it is replaced by a new one.

The production of aluminum via molten salt electrolysis takes place in a temperature range of about 940° to 975° C.

The electrical currents employed for the electrolytic cells (often called pots for short) which are connected in series, are usually of the order of 100–200 kA (kiloampere). At such currents the surface of the liquid aluminum on the floor of the cell is no longer horizontal. Forces due to magnetic fields and horizontal components of electrical current act on the molten metal causing pronounced fluctuations in level and also movements which can be of the order of several centimeters.

Both changes in level and movements in the molten metal are, for various reasons, disadvantageous to the economics of aluminum production:

(a) The distance between the anodes and the surface of the aluminum which forms the cathode must be kept excessively large, which means a greater voltage drop and therefore a greater consumption of energy.

(b) The lining of the cell is subject to greater consumption or wear. Also, cracks or holes can result making premature replacement or repair necessary. The costs incurred are great as, in addition to the expense of labour and materials, there is also a loss in production.

In view of this efforts have been made for a long time now to reduce these movements and changes in level of the liquid metal to a minimum or even to eliminate such effects completely where possible.

The first efforts were aimed at achieving as uniform as possible distribution of current between the anodes and the cathode. On route from the carbon anodes to the carbon floor of the cell the electrical current flows first through the fluoride melt which forms the electrolyte and then through the liquid metal. The electrical resistance of the electrolyte is incomparably greater than that of the carbon or, in particular, that of the metal. It is therefore relatively easy to keep the flow of current vertical through the electrolyte. In liquid metal on the other hand besides the desired, and for the electrolysis necessary, vertical components of electrical current there are also undesired horizontal components of current.

Also, the busbars which conduct very large current produce magnetic fields. The vertical flux lines of these magnetic fields create electromotive forces running in the horizontal direction in the molten aluminum.

The cells are usually constructed in a steel shell. The magnetic conductive material allows the interior of the pot to be screened partly from the magnetic fields produced outside the pot.

In the German Pat. No. 1 083 564 an attempt is made to suppress and/or keep constant the vertical components of the vertical fields of current flowing uniformly and in the vertical direction over the whole of the surface of the cell. To this end the surface of the metal which acts as the cathode is matched to the anodes and as much as possible of the horizontal busbars arranged such that the surface area is as large as possible.

From the German Pat. No. 1 143 032 it is known that the effect of the magnetic fields from the external conductors can be removed to a large extent by installing iron screening between the busbars and the pot. Although the heat produced in the pot can be influenced there are no indications that movement of the metal can be prevented.

Finally, in the German Pat. No. 2 213 226 the magnetic fields at the sides and ends of the pot are influenced by the provision of additional magnetic conductors in the region of the pot. These magnetic conductors which run vertically are separate from each other and from the electrical system of the pot, and are situated in or on the pot wall between the layer of liquid metal and the busbars outside the pot. This is to say, they terminate in the magnetic, non-conductive carbon.

All these above mentioned devices feature the disadvantage that they involve relatively extensive and expensive measures, and can not be implemented without re-building or modifying the pot.

SUMMARY OF THE INVENTION

The inventor therefore set himself the task of developing a device to absorb vertical magnetic fields in electrolytic reduction cells, whereby the said device would be simple in design and could be installed on existing reduction cells without interrupting production.

This object is achieved by way of the invention in that the device comprises the steel shell of the pot and attached magnetically to it, a covering for the upper part of the pot made of a metal of high magnetic conductivity, whereby the screening effect is uniform over the whole pot.

The magnetic attachment of the covering to the shell is of fundamental importance as the steel shell, which is a necessary part of all pots, can be used for a part of the magnetic screening and the whole screening is at the same potential.

A ferromagnetic metal, in particular iron or steel, is employed for the screening. Although cobalt and nickel and their alloys could be used, for reasons of costs they are not considered in practice.

BRIEF DESCRIPTION OF DRAWINGS

The invention will now be explained in greater deal with the help of the following schematic exemplified embodiments viz.

DETAILED DESCRIPTION

Figure 1:
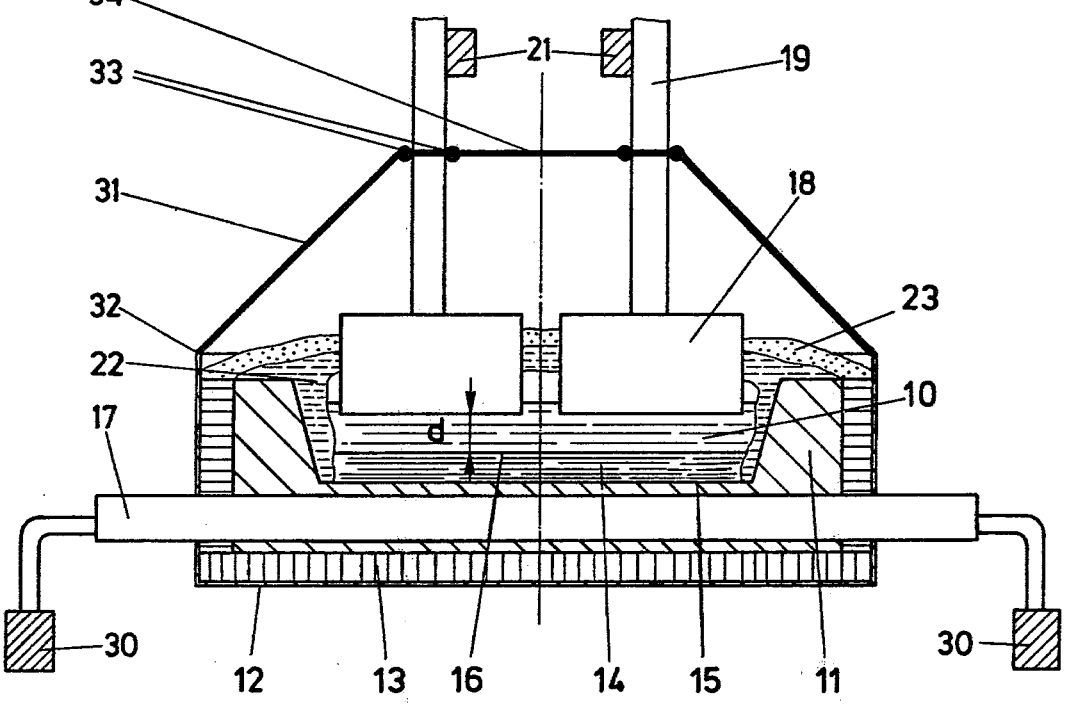
FIG. 1: An electrolytic reduction cell shown in vertical cross section and having a fume hood installed to provide magnetic screening.

Encapsulation of reduction cells is required increasingly today for reasons of work place hygene and for protection of the environment. In terms of the present invention, an existing fume hood of the conventional kind with central and side covering can be employed between the anode beam and the top of the anode, if it is magnetically connected to the shell of the pot and is electrically insulated from the anode conductor bars. The central covering can be connected directly to the shell and/or the side covering.

In the case of cells with the centrally fed or so-called point feeding system the central cover between the series of anodes can be replaced wholly or partly by a container or silo or the likes of alumina. It is then understood of course that this silo must also be connected magnetically to the shell and/or side cover.

In non-capsulated pots a coarse grid mesh can be provided between the tops of the anodes and the anode beam. This mesh is magnetically coupled to the steel shell of the pot, and contact with all parts at anode potential is avoided. For practical reasons, in particular because of the need to change anodes, the spacing of the mesh corresponds at least to the dimensions of the anodes being used. This mesh must also be strong enough to be able to withstand blows during the insertion and removal of anodes without suffering damage.

It has been found particularly advantageous to provide a yoke which extends over the whole length of the pot above the space between the rows of anodes and runs horizontally at a level between the anode beam and the tops of the anode. If only one yoke is to be employed, this is usefully situated along a central plane between the rows of anodes. Two yokes can run side by side separated along this central plane.

As with the rods of the mesh, the cross section of the yoke can be chosen at will. It can for example be round, rectangular or be some other form of solid or hollow section, sheet or plate. Preferably however, pipes are employed; these can have an outer diameter of 5–15 cm, in particular 7–10 cm. The wall thickness is of the order of one to several centimeters and is limited by the strength required of the pipe.

The yokes can have transverse components which may be of the same or different cross section. The transverse parts, which preferably run outwards at right angles, are designed such that they improve the magnetic screening but do not hinder operation of the cell e.g. feeding. Although these transverse arms of the yoke normally run in the same horizontal plane as the rest of the yoke they may lie at an angle of up to about 45° upwards or downwards.

The yokes running the length of the pot can be replaced by others which extend over the whole width of the pot. These, usually single yokes, lie along the central plane between two neighboring anodes. They can, as required, be installed along all central planes between anodes, on each second, third or fourth plane etc. The number of yokes can be reduced to such an extent that the screening still takes place over the whole of the electrolytic cell. All the other details for the yoke running lengthwise e.g. height, transverse components and shape in cross section, also hold for the yoke running across the cell.

All the described magnetic covers for the non-capsulated pot can be installed while the pot is under full production. The magnetic coupling to the steel shell, which can at the same time also be the means of mechanical fixing, is made releasably using bolts, clamps etc., or permanently by means of rivets, welding etc.

The mesh or yokes of the invention can at the same time serve as the supporting frame for alumina silos or crust breaking devices, if installed on pots with central, transverse (U.S. patent application Ser. No. 916,970) or point feeding systems. It is understood of course that such devices mounted on the screening mesh or yokes must be insulated from the parts of the cell at anode potential.

Surprisingly, using the simple magnetic screening described here, e.g. with a single or double yoke running lengthwise above the space between the rows of anodes, improved efficiency can be attained in that at least 50 mV can be saved per pot, which leads to a corresponding reduction in the cost of producing primary aluminum.

In summary, the arrangement proposed by the invention, in the simple case where the operation of the cell is not interrupted, brings the following advantages:

(a) Lower energy consumption due to more stable operation of the cell (reduction in the occurrance of fluctuations).

(b) Higher electrical yield due to lower temperatures and more stable operation.

(c) Lower consumption of electrolyte.

(d) Lower anode consumption.

FIGS. 1 to 5 show a part of an electrolytic reduction cell. The steel shell 12, which is lined with carbon 11 and thermal insulation 13 made of a heat resistant, insulating material, contains the fluoride melt 10 which constitutes the electrolyte. The deposited aluminum 14 on the floor of the cell is connected to the cathode, and therefore the surface 16 of the liquid aluminum is the cathode of the cell. Iron cathode bars 17 embedded in the carbon lining 11 transverse to the length of the cell conduct the direct electrical current from the carbon lining of the cell out of the cell at the sides. Anodes 18 made of amorphous carbon dip into the fluoride melt 10 from above and conduct the direct electrical current to the electrolyte. The anodes 18 are connected securely via anode conductor bars 19 and clamps 20 to the anode beam 21. The current flows from the cathode bars 17 of one cell to the anode beam or beams 21 of the next cell via conventional busbars which are not shown here. The current then flows via the anode bars 19, the anodes 18, the electrolyte 10, the liquid aluminum 14 and the carbon lining 11 to the cathode bars 17. The electrolyte 10 is covered with a crust 22 of solidified melt which is in turn covered with a layer 23 of aluminum oxide. In practice spaces form between the electrolyte 10 and the solidified crust 22. A crust of solidified electrolyte also forms at the sidewalls of the carbon lining 11 to form a border there. This border determines the horizontal width of the bath comprised of liquid aluminum 14 and electrolyte 10.

The distance d between the bottom face 24 of the anodes 18 and the surface 16 of the aluminum, known as the interpolar distance, can be changed by raising or lowering the anode beam 21 by means of the hoists 25 mounted on columns 26. On setting the hoist 25 into operation all anodes are raised or lowered simultaneously. Furthermore, the anodes can be raised or lowered individually in a conventional manner by means of the clamps 20 on the anode beam 21.

The busbars 30 outside the reduction cells conduct the electrical current to the anode beam of the next cell.

The fume hood shown in FIG. 1 comprises sidewall covering 31 which is connected magnetically to the steel shell via 32 and is electrically insulated from the anode beams 19 via 33 and the central covering 34 which is likewise electrically insulated from the anode beams 19 via 33. The central covering 34 is connected magnetically to the shell 12 and/or to the sidewall covering 31.

As has been mentioned already, the central covering 34 can be replaced partly or wholly by an alumina silo, but also by a suspended device or fume extraction pipe.

Figure 2:
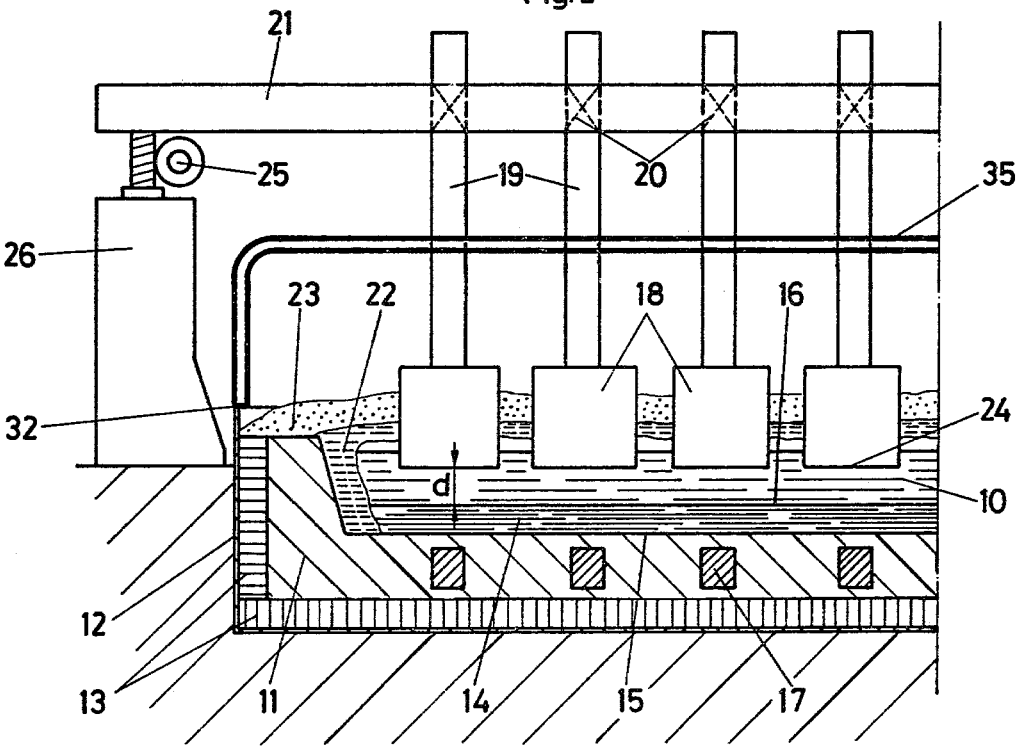
FIGS. 2 and 3: Vertical cross sections, both transverse and longitudinal, of an electrolytic reduction cell with a plate running lengthwise installed for magnetic screening purposes.
Figure 3:
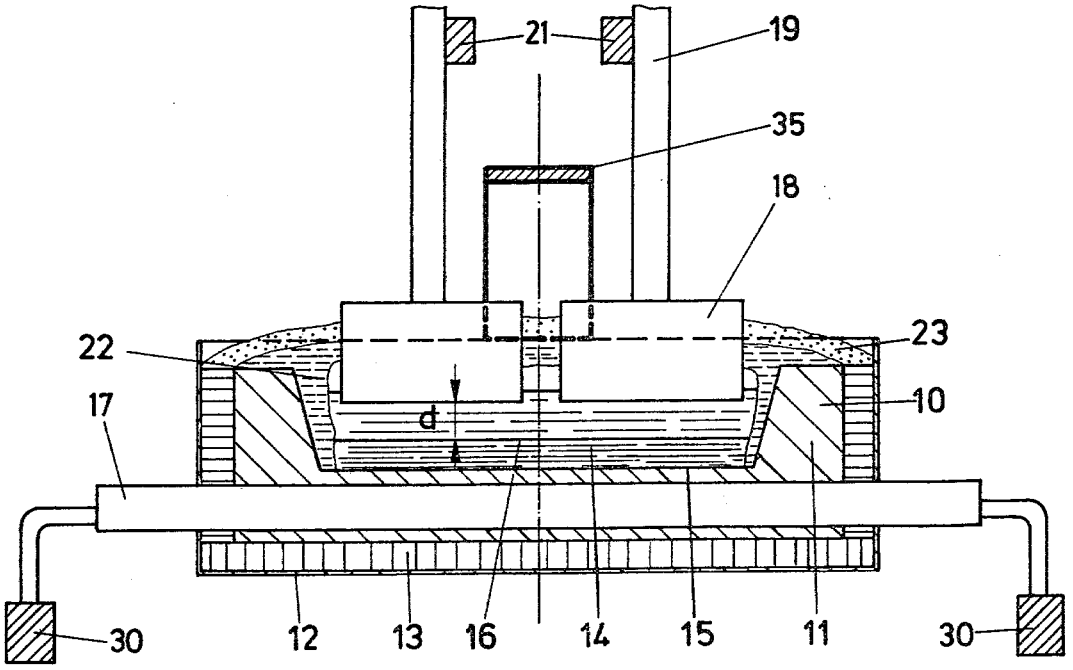

In FIGS. 2 and 3 the magnetic screening is shown as a plate 35 bent over at both ends and connected to the shell via 32. This plate is positioned about midway between the head of the anode 18 and the anode beams 21.

Figure 4:
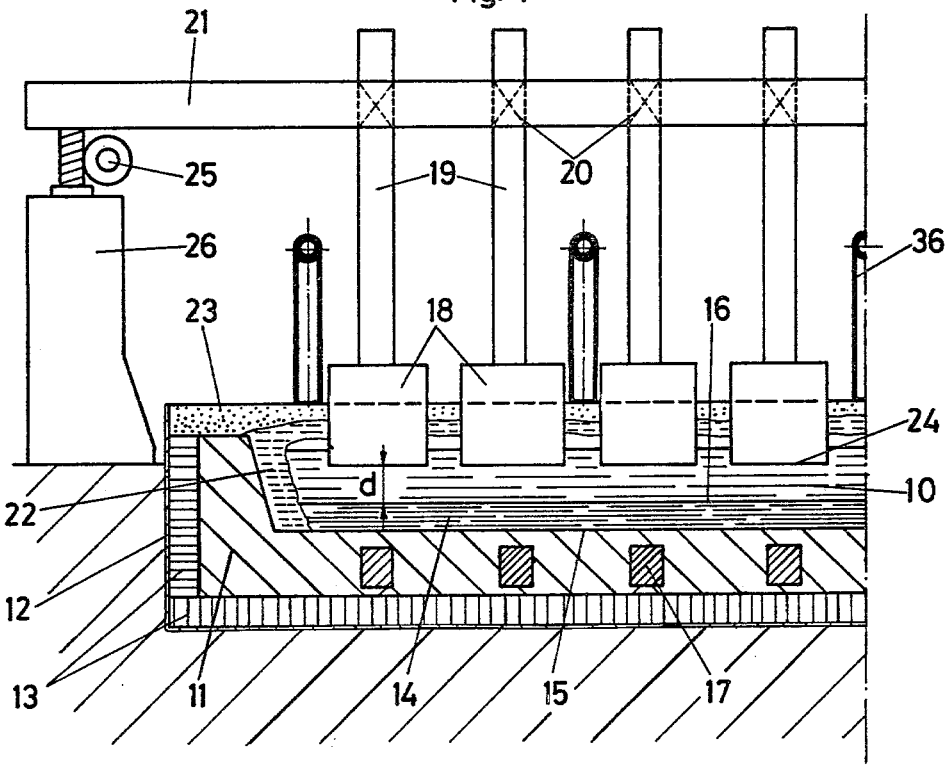
FIGS. 4 and 5: An electrolytic reduction cell as in FIGS. 2 and 3 with tubes running across the width of the cell to serve as magnetic screening.
Figure 5:
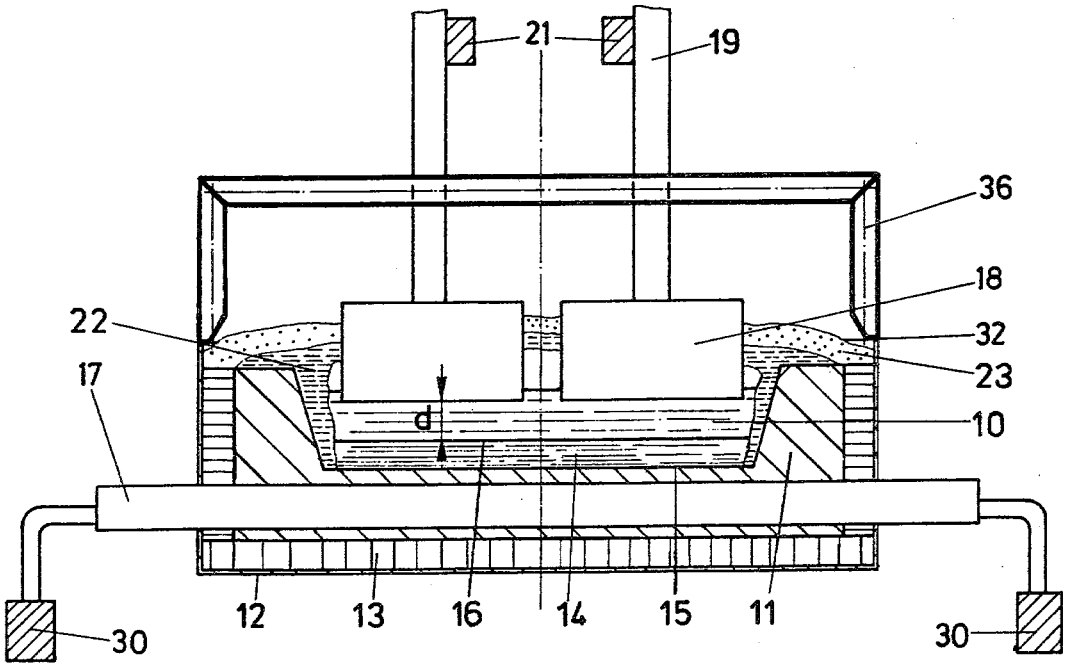

In FIGS. 4 and 5 the magnetic screening is provided by tubes 36 which extend over the whole width of the cell and are bent at both ends and result in a coarse grid mesh. The tubes are connected via 32 to the shell 12 at both ends of the series of anodes and after each second anode. The pipes are again positioned midway between the top of the anode 18 and the anode beam 21.

What is claimed is:

1. Device for absorbing vertical magnetic fields in electrolytic reduction cells having a cathode, an electrolyte and anodes immersed therein, in which the said device comprises the steel shell of the reduction cell and for the upper part of the cell a covering magnetically coupled to said shell, which covering is made of a metal of high magnetic conductivity, whereby the screening effect is uniform over the whole of the cell and the screening is at the same potential resulting in improved efficiency and reduction in cost.

2. Device according to claim 1 wherein said anodes are connected to an anode beam above the cell and wherein said covering is a fume hood mounted between the anode beam and the tops of the anodes, said hood being insulated electrically from the anodes and connected magnetically to the steel shell.

3. Device according to claim 2 wherein said hood includes a central covering between anodes.

4. Device according to claim 1 wherein said anodes are connected to an anode beam above the cell and wherein the covering comprises a coarse grid mesh which is situated in a horizontal plane between the anode beam and the top of the anodes.

5. Device according to claim 1 wherein said anodes are connected to an anode beam above the cell and wherein the covering comprises at least one yoke which lies in a horizontal plane between the anode beam and the top of the anodes, extends over the whole length of the shell of the reduction cell and runs above the space between the rows of anodes.

6. Device according to claim 1 wherein said anodes are connected to an anode beam above the cell and wherein the covering comprises at least one yoke which lies in a horizontal plane between the anode beam and the top of the anodes, running across the whole width of the cell above the space between the anodes.

7. Device according to claim 5 wherein said yoke is made of solid or hollow sections, plates or sheets.

8. Device according to claim 6 wherein said yoke is made of solid or hollow sections, plates or sheets.

9. Device according to claim 7 in which the hollow sections are pipes with an outer diameter of 5–15 cm.

10. Device according to claim 8 in which the hollow sections are pipes with an outer diameter of 5–15 cm.

11. Device according to claim 5 in which said yoke includes transverse components.

12. Device according to claim 6 in which said yoke includes transverse components.

13. Device according to claim 1 wherein the covering is made of iron or steel.

14. Device according to claim 1 for the production of aluminum.

15. Device according to claim 1 wherein said covering is mounted above the cell.

* * * * *